United States Patent [19]

Pierce

[11] 4,042,313

[45] Aug. 16, 1977

[54] METHOD OF IMPARTING COLOR TO FIRES

[75] Inventor: Richard H. Pierce, Broomall, Pa.

[73] Assignee: Philadelphia Quartz Company, Valley Forge, Pennsylvania

[21] Appl. No.: 668,387

[22] Filed: Mar. 19, 1976

[51] Int. Cl.[2] ..... C10L 10/00; C06B 43/00

[52] U.S. Cl. ..... 431/4; 431/126; 44/6; 44/1 R

[58] Field of Search ..... 431/4, 126; 44/1 R, 44/6

[56] References Cited

U.S. PATENT DOCUMENTS

| | | | |
|---|---|---|---|
| 1,977,890 | 10/1934 | Ohlwiler | 44/6 |
| 2,219,565 | 10/1940 | Riemer | 44/1 R |
| 2,320,330 | 5/1943 | Fiske | 44/1 R X |
| 3,447,881 | 6/1969 | Fay et al. | 431/126 |
| 3,468,615 | 9/1969 | Carey | 44/6 X |
| 3,627,489 | 12/1971 | Alquist | 44/1 R |
| 3,637,355 | 1/1972 | Brockbank | 44/1 R |
| 3,811,817 | 5/1974 | Mansnerus et al. | 431/126 |

FOREIGN PATENT DOCUMENTS

| | | | |
|---|---|---|---|
| 1,945,120 | 3/1971 | Germany | 431/126 |
| 2,222,939 | 11/1972 | Germany | 431/126 |
| 705,109 | 11/1951 | United Kingdom | 44/1 R |

*Primary Examiner*—Edward G. Favors
*Assistant Examiner*—Larry Jones
*Attorney, Agent, or Firm*—Ernest G. Posner; Fred C. Phelpitt; J. S. Stephen Babb

[57] ABSTRACT

An improved method of imparting colors to fires in home fireplaces is described as well as the preparation of the materials used to provide said color. Metal salts which impart color to flames are granulated using hydrated alkali metal silicate as a binder. When these granules are added to fires, the silicate binder softens on contact with warm or hot combustible material. The silicate then loses water and is transformed to a solid once more so that the material becomes bonded to the combustibles. Upon burning the metal salts are decomposed and the flames are colored. The system is very efficient and proper application requires the use of bulking agents in the granules.

4 Claims, No Drawings

METHOD OF IMPARTING COLOR TO FIRES

BACKGROUND

This invention relates to an improved method of adding metals salts to wood, coal, charcoal or paper fires commonly built in home fireplaces.

Interesting and pleasing color effects can be produced by the introduction of certain metal salts into fires usually built in home fireplaces. Presently such materials are dry blends of the varius components and as such, have certain disadvantages. These blends are nonhomogeneous, consisting of various particle sizes and shapes. These conditions lead to segregation of the powder during storage, handling and especially application. In addition the finer particles contained in these blends tend to become entrained in the combustion gases exiting the fireplace thereby losing their value while contributing to air pollution. Additional material can be lost because these powders do not adhere to the combustibles and a significant proportion fall to the bottom of the fireplace and are not utilized.

SUMMARY OF THE INVENTION

An improved method of forming colored flames in fires built in home fireplaces involves the addition of granules containing colorants bound or agglomerated with hydrated alkali metal silicate. Upon contact with warm or hot logs or other combustible materials, the hydrated alkali metal silicate softens or melts. The heat causes the loss of water so that the silicate rehardens and the composition is bonded to the combustibles. As the fire burns thereby consuming the wood and such, the coloring agents are decomposed imparting color to the flame. The granules containing the colorants are prepared by providing a mass of the desired metal silicate, and drying to obtain the desired moisture content.

The efficient nature of this method of adding colorants to fires requires that bulking agents be added to the composition. The addition of such relatively inert agents is required to obtain distribution of the granules throughout a significant portion of the fire.

THE INVENTION

The coloring agents, alkali metal silicate binder and generally inert bulking agents, comprise the granules used to impart color to flames according to the method of my invention. The salts of any metal that provides the desired color can be added to the granules. Among others, metals that provide colorful flames include antimony, arsenic, boron, chromium, calcium, copper, lithium, lead, potassium, manganese, nickel, selenium, strontium, thallium, and zinc. I prefer to use antimony, boron, chromium, copper, calcium, lithium, potassium, manganese, nickel and zinc as these metals are the most environmentally acceptable. Among others the salts of these metals that can be used include sulfate, phosphate, carbonate, acetate, oxalates and formates. I prefer to use carbonates, acetates, oxalates and formates since these compounds decompose into $CO_2$ and water vapor. I especially prefer to use carbonates for economic reasons. Large amounts of sodium and barium salts should not be used since the flame colors developed by these metals tend to mask other flame colors.

While the granules used in the method of my invention can be prepared with any alkali metal silicate as the binder, sodium interferes with the development of other flame colors and is of limited usefulness. Potassium and lithium silicates are quite suitable for the binder since both metals provide colorful flames (violet and crimson respectively) and do not mask other colors. I prefer to use potassium silicate.

The preferred preparation of the granules according to the method of my invention requires that the granules contain a bulking agent. Compositions of this type are applied directly on the fire. Application is accomplished by tossing a handful, spoonful or capful of material directly onto or into the ignited fire. If no bulking agent were added to the granules used in my method, the amount required to impart the desired colors would be very small and this amount would be less easily applied by these methods. The bulking agents should be relatively inert and should not interfere with the other functions that are required in my method. Common bulking agents such as sodium sulfate and sodium carbonate are unsuitable for this application. I have found that sand and other forms of relatively pure amorphous or microcrystalline silica are the most useful bulking agents.

The granules are prepared by admixing 10 to 25 pbw of the desired metal salt(s) with 35 to 82 pbw of the bulking agent until it is uniform. Sufficient potassium or lithium silicate solution to provide 8 to 40 pbw of silicate solids is added and blended with this composition. The blending is continued until uniform granules develop. This material is dried in any suitable manner to provide apparently dry granules of sufficient strength. A heated rotating drum that provides a tumbling action is desirable for this purpose. The extent to which the material is dried is of critical importance to the method of my invention. If the material is over-dried, it will not melt quickly enough to adhere to the combustible material. A composition with too much moisture will cake in the container and will be almost useless. I have found that between 8 and 27% water is useful but that 9 to 17% provides a product with the most desirable properties.

The silicate solutions used in this preparation have about 1 to 5 mols of $SiO_2$ per mol of $K_2O$ or about 2 to 12 mols of $SiO_2$ per mol of $Li_2O$. The potassium silicates contain 15 to 40% silicate solids while the lithium silicates have 15 to 35% silicate solids.

The product of this preparation and the material employed in my method of coloring flames contains 7.3 to 23% by weight of metal salt(s), 6.5 to 37% by weight silicate solids as the binder, 24 to 75% by weight of bulking agent and 8 to 25% by weight of water.

Generally fires that are prepared with materials such as wood or paper burn with a predominately yellow flame. The color of such flames can be altered by the addition of granules according to my invention containing one or more metal salts. Blue, pale blues, greens and pale greens are prevalent flame colors produced by such metals as antimony, arsenic, boron, copper, lead and nickel. Red of crimson flames can be produced using calcium or lithium salts while potassium salts yield violet flames.

EXAMPLES

The following examples are illustrative of certain embodiments of my invention and should not be considered restrictive. The scope and limits of my invention are clearly recited in the claims. All proportions are in parts-by-weight (pbw) unless otherwise indicated.

EXAMPLE 1

Color producing granules for fires were prepared as follows. Copper sulfate, nickel carbonate and calcium carbonate (6 pbw each) were blended with 55 pbw of fine sand. Blending was continued until a uniform mixture was obtained. Then 54 pbw of a solution containing 15 pbw of potassium silicate with a mol ratio of 3.3 $SiO_2/1\ K_2O$ was blended with the uniform mixture until damp granules were formed. These granules were charged to a rotary dryer and dried at 95° C until a moisture content of 12% was obtained. This product was a free flowing, non-caking granular powder of uniform composition and particle size.

These granules were used to color a wood fire in a home fireplace by tossing 25 to 50 grams onto the burning wood at various intervals. The granules could be seen to melt and then to bond onto the surface of the wood. Very few of the granules fell to the bottom of the fireplace and no particles could be seen exiting with the combustion gases. The predominately yellow flame changed to green, then red with occasional flashes of violet.

EXAMPLE 2

Lithium acetate (12 pbw) was blended with 61 pbw of sand. Blending was continued until a uniform mixture was obtained. Then 54 pbw of a solution containing 15 pbw of lithium silicate with a mol ratio of 4.5 $SiO_2/1\ LiO_2O$ was blended with the uniform mixture until damp granules were formed. These granules were charged to a rotary dryer and dried at 70° C until a moisture content of 15% was obtained. This product was a free-flowing, non-caking granular powder of uniform composition and particle size.

These granules were used to color a wood fire in a home fireplace by tossing 35 to 55 grams onto the burning logs. The behavior and attributes of the product were the same as described in Example 1 except that the colored flames were crimson.

I claim:

1. In the burning of combustible materials, a method of imparting color to the flames, comprising; adding granules to burning combustible materials whereby the granules soften and become bonded to the combustibles and upon burning impart color to the flames; said granules consisting essentially of metal salt(s), one or more of which is selected from the group of metals that produce colored flames on decomposing in a fire, potassium or lithium silicate solids water, and a bulking agent selected from the group consisting of sand, amorphous silica and microcrystalline silica.

2. In the burning of combustible materials, a method for imparting color to the flames, comprising; adding granules to combustible materials, whereby the granules soften and become bonded to the combustible and upon burning impart colors to the flames, said granules consisting essentially of:

a. 7.3 to 23% by weight of one or more metal salts selected from the group consisting of the carbonates, acetate, oxalates or formates of antimony, arsenic, boron, chromium, copper, calcium, lithium, lead, potassium, magnesium, nickel, selenium, strontium, thallium and zinc;

b. 6.5 to 37% by weight of silicate solids said silicate being potassium silicate having 1 to 5 mols of $SiO_2$ per mol of $K_2O$ or lithium silicate having 2 to 12 mols of $SiO_2$ per mol of $Li_2O$;

c. 24 to 75% by weight of sand, amorphous or microcrystalline silica, and d. 8 to 25% by weight of water.

3. Granules used to impart colors to flame consisting essentially of:

a. 7.3 to 23% by weight of one or more metal salts selected from those metal salts that impart colors to flames;

b. 6.5 to 37% by weight of potassium or lithium silicate solids, wherein the potassium silicate has 1 to 5 mols of $SiO_2$ per mol of $K_2O$ and the lithium silicate has 2 to 12 mols of $SiO_2$ per mol of $Li_2O$;

c. 24 to 75% by weight of sand, amorphous or microcrystalline silica, and d. 8 to 25% water

4. The granules of claim 3 wherein the metal salts are one or more selected from the goup consisting of the sulfates, phosphates, carbonates, acetates, oxalates and formates of antimony, arsenic, boron, chromium, calcium, copper, lithium, lead, potassium, magnesium, nickel, selecium, strontium, thallium and zinc.

* * * * *